United States Patent [19]

Gillespie, Jr.

[11] Patent Number: 4,508,337

[45] Date of Patent: Apr. 2, 1985

[54] BASKETBALL GOAL HEIGHT REDUCING FRAME

[76] Inventor: C. Earl Gillespie, Jr., 2114 Rock Ridge, Memphis, Tenn. 38134

[21] Appl. No.: 592,561

[22] Filed: Mar. 23, 1984

[51] Int. Cl.[3] ..... A63B 63/08

[52] U.S. Cl. ..... 273/1.5 R

[58] Field of Search ..... 273/1.5 R, 1.5 A

[56] References Cited

U.S. PATENT DOCUMENTS

| | | | |
|---|---|---|---|
| 2,517,463 | 8/1950 | Cobb | 273/1.5 R |
| 2,707,104 | 4/1955 | Killick | 273/1.5 R |
| 3,622,155 | 11/1971 | Hirsch | 273/1.5 R |
| 3,970,304 | 7/1976 | Ebstein et al. | 273/1.5 R |
| 4,183,522 | 1/1980 | Killen | 273/1.5 R |

FOREIGN PATENT DOCUMENTS

| | | | |
|---|---|---|---|
| 1070012 | 5/1967 | United Kingdom | 273/1.5 R |

*Primary Examiner*—Paul E. Shapiro

*Attorney, Agent, or Firm*—Walker & McKenzie

[57] ABSTRACT

A frame for securing a substantially typical basketball goal/backboard assembly to a self-supported basketball goal/backboard assembly at a lower height than the self-supported basketball goal/backboard assembly. The frame includes support members for being attached to an auxiliary basketball goal/backboard assembly, hanger members for being attached to the backboard of a self-supported primary basketball goal/backboard assembly, and a truss-like linkage joining the support members and hanger members with the auxiliary basketball goal/backboard assembly positioned lower than the primary basketball goal/backboard assembly.

4 Claims, 6 Drawing Figures

11
15
83
27'
51'
51
45
55
51"
47
27
30a
23
53'
53
49
53"
15
85
26
59"
25'
30b
59
65
57
33'
27"
61"
67
28
59'
63
29
25
71'
61
36a
30c
71
77
61'
33
25"
71'
79
73"
32
75
73
31'
36b
69
81'
81
33"
73'
81"
37
41'
34
41
87
43'
41"
31
36c
95
89
39
95
43
93
93
35
43"
31"
95
95
93
93
19

BASKETBALL GOAL HEIGHT REDUCING FRAME

FIELD OF THE INVENTION

The present invention relates to a removable framing device used to regulate the height of a basketball goal and backboard assembly or the like.

DESCRIPTION OF THE PRIOR ART

Heretofore, various basketball goal height reducing devices have been patented. U.S. Pat. No. 2,707,104 granted to Killick discloses a substantially smaller basketball hoop and backboard attaching to the rim of the basketball hoop. Other basketball goal height reducing devices are disclosed in U.S. Pat. No. 4,218,058 granted to Hilbert et al; U.S. Pat. No. 4,330,101 granted to Andersen; U.S. Pat. No. 4,395,040 granted to White; U.S. Pat. No. 2,517,463 granted to Cobb; U.S. Pat. No. 2,039,794 granted to Hayden; U.S. Pat. No. 1,878,864 granted to Lane et al. None of the above mentioned patents disclose or suggest the present invention.

SUMMARY OF THE INVENTION

The concept of the present invention is to provide a sturdy lightweight frame for removably securing an auxiliary basketball goal and backboard assembly to an existing primary basketball goal and backboard assembly.

An object of the present invention is to lower the height of the basketball goal and backboard assembly from a 10 foot (3.0 m) height to either a 9 foot (2.7 m) or an 8.5 foot (2.55 m) height.

Another object is to provide a safe and sturdy basketball goal and backboard assembly that may be used for smaller children.

A further object is that the frame extends out away from the existing basketball goal, therefore, producing a smaller playing court for the smaller children.

Still another object is that the adjustment of the desired height may be completed on the floor before the frame is installed on the primary basketball goal and backboard assembly.

The basketball goal height reducing frame includes a linkage means, a hanger means for attaching the linkage means to the top of a primary basketball goal and backboard assembly, and a support means for securing an auxiliary basketball goal and backboard assembly to the linkage means.

DESCRIPTION OF THE PREFERRED EMBODIMENT

Figure 1:
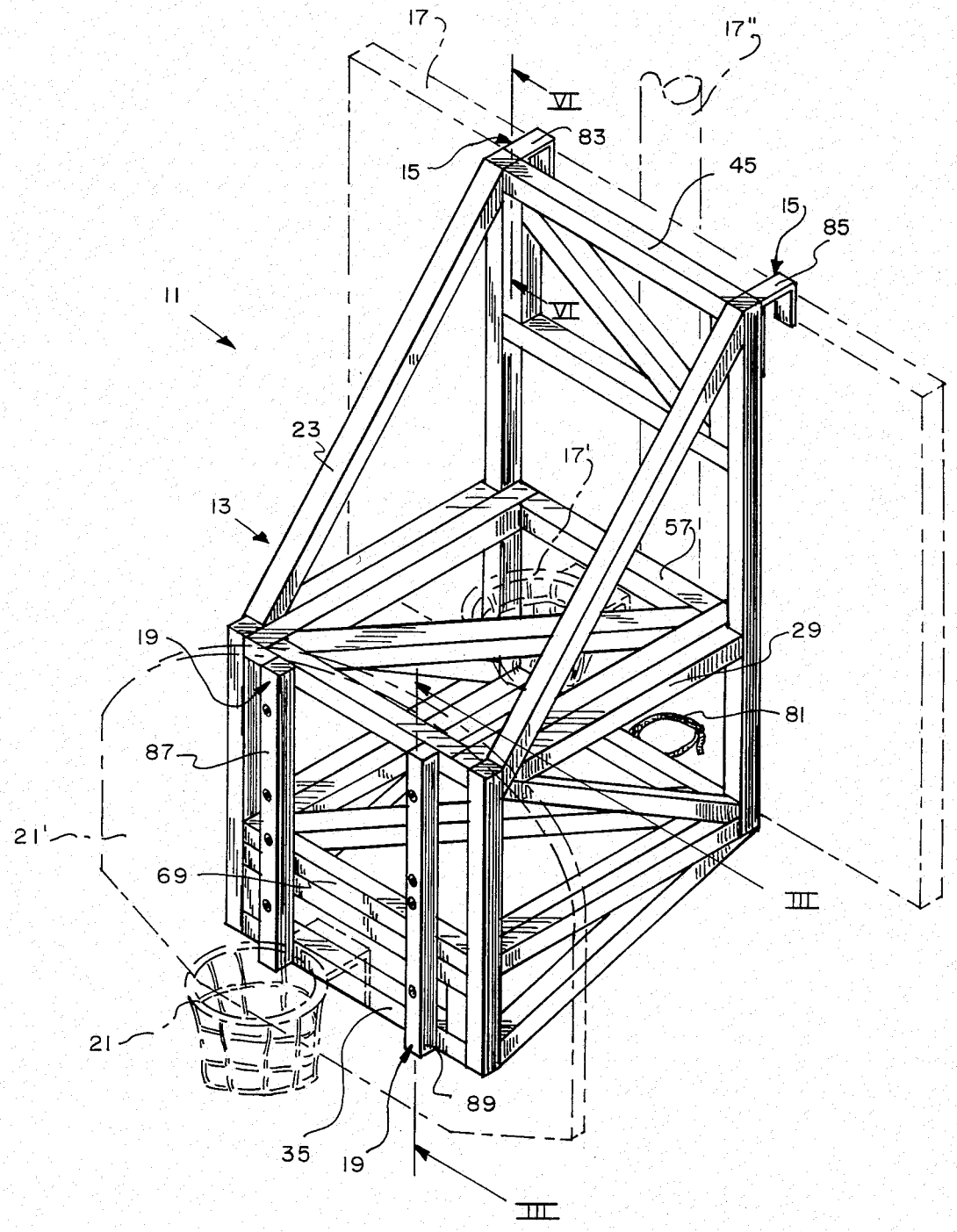
FIG. 1 is a perspective view of the basketball goal height reducing frame of the present invention with a primary and auxiliary basketball goal and backboard assembly shown in phantom lines.

The basketball goal height reducing frame 11 of the present invention includes, in general, a linkage means 13, a hanger means 15 for attachment of the linkage means 13 to the backboard 17 of a primary basketball goal 17', and a support means 19 for securing an auxiliary basketball goal 21/backboard 21' assembly thereto. (See, in general, FIGS. 1 and 2).

Figure 2:
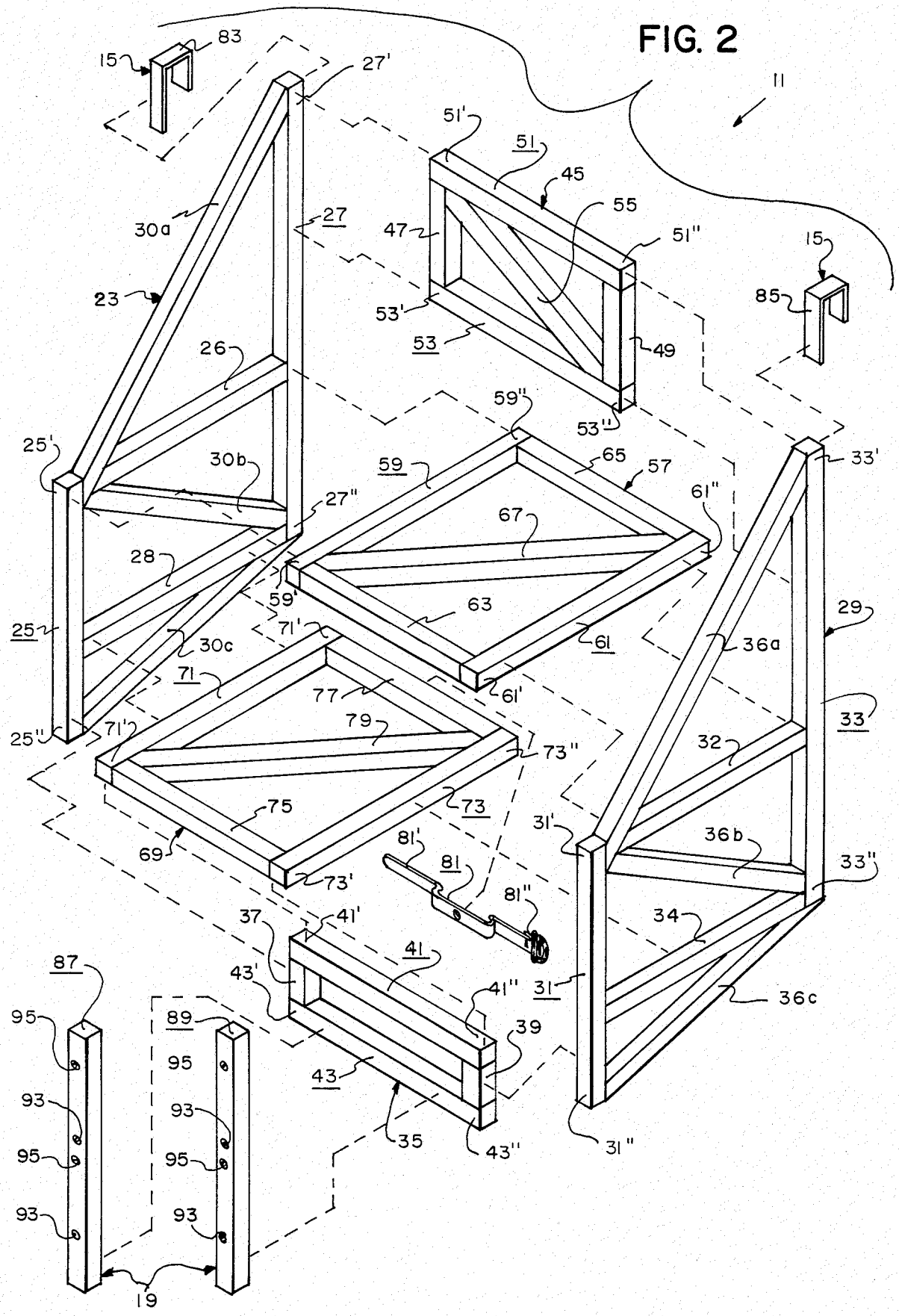
FIG. 2 is an exploded view showing the components of the basketball goal height reducing frame.
Figure 3:
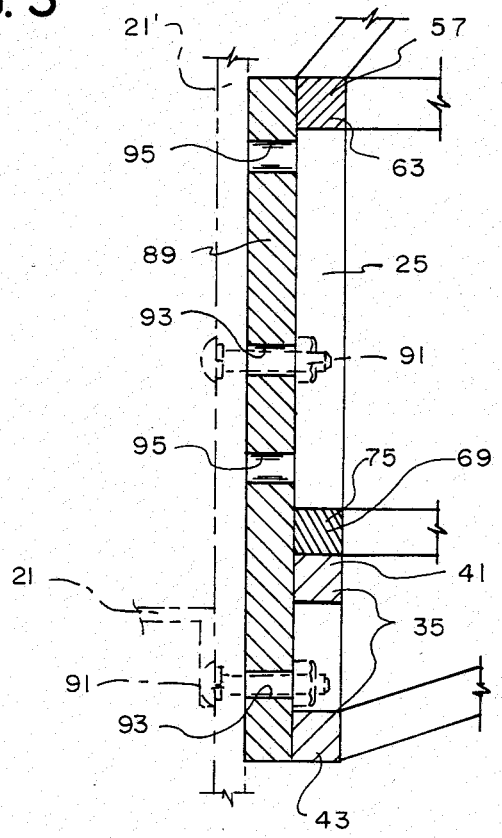
FIG. 3 is an enlarged sectional view substantially as taken on line III—III of FIG. 1 showing a portion of the auxiliary basketball goal and backboard assembly and attaching bolts, etc. in phantom lines.

The linkage means 13 as shown in FIGS. 1 and 2 includes a first side truss 23 including upwardly extending first and second ends 25, 27 with the first end 25 being substantially shorter in height relative to the second end 27 thereof. The first end 25 is in a vertical position spaced in front of the second end 27 and rigidly attached thereto by a plurality of cross members 26, 28, and diagonal members 30*a*, 30*b*, 30*c*. The upper end 27' of the second end 27 is substantially higher relative to the upper end 25' of the first end 25 and the lower end 25'' of the first end 25 is substantially lower relative to the lower end 27'' of the second end 27. the first side truss 23 defines one side of the basketball goal height reducing frame 11 and in constructed out of a rigid material, such as wood or metal, in a manner apparent to those skilled in the art.

The linkage means 13 includes a second side truss 29 which is identical to the first side truss 23 including upwardly extending first and second ends 31, 33. The vertical first end 31 is positioned in front of the vertical second end 33 and rigidly attached thereto by a plurality of cross members 32, 34 and diagonal members 36*a*, 36*b*, 36*c*. The upper end 33' of the second end 33 is substantially higher relative to the upper end 31' of the first end 31 and the lower end 31'' of the first end 31 is substantially lower relative to the lower end 33'' of the second end 33. The second end truss 29 defines another side of the basketball goal height reducing frame 11.

The linkage means 13 includes a first end truss member 35 comprising a first side 37, a second side 39, a top 41 and a bottom 43. The upwardly extending first side 37 and second side 39 are positioned in spaced relationship opposite one another. The horizontal top 41 is rigidly attached at the first end 41' to the upper end of the first side 37 and at the second end 41'' to the upper end of the second side 39. Likewise, the first end 43' of the bottom 43 is rigidly attached to the lower end of the first side 37 and the second end 43'' is rigidly attached to the lower end of the second side 39, therefore, forming an elongated rectangular shaped first end truss member 35.

The first side 37 of the first end truss member 35, the first end 41' of the top 41 and the first end 43' of the bottom 43 are fixedly attached to the lower end 25'' of the first end 25 of the first side truss 23 so that the underneath side of the first end 43' of the bottom 43 is aligned with the underneath side of the lower end 25'' of the first end 25 of the first side truss 25 with the first side 37 and first end 41' of the top 41 extending upwardly therefrom. Similarly, the second side 39, the second end 41'' of the top 41 and the second end 43'' of the bottom 43 is fixedly attached to the lower end 31'' of the first end 31 of the second side truss 33 with the underneath side of the second end 43'' of the bottom 43 aligned with the underneath side of the lower end 31" of the first end 31 of the second side truss 29. Thus, the first side truss 23 and the second side truss 29 are coupled together with the first end truss 35 forming the lower front portion of the basketball goal height reducing frame 11. (See FIGS. 1 and 2).

The frame 11 includes a second end truss member 45 comprising upwardly extending first and second sides 47, 49, a horizontal top and bottom 51, 53 and brace 55. The first end 51' of the top 51 is rigidly attached to the upper end of the first side 47, the second end 51" is rigidly attached to the upper end of the second side 49, the uppermost portion of the first end 53' of the bottom 53 is rigidly attached to the lower end of the first side 47 and the second end 53" is rigidly attached to the lower end of the second side 49 forming a rectangular shaped second end truss member 45. The brace 55 has one end rigidly attached to the underneath corner where the first side 47 and the first end 51' of the top converge and runs diagonally to the other end that is also rigidly attached to the topside of the second end 53" of the bottom 53 where the lower end of the second side 49 converge. The diagonally running brace 55 adds strength to the rectangular shaped second end truss member 45.

Looking at FIGS. 1 and 2, it will be seen that the second end truss 45 is fixedly attached to the first and second side trusses 23, 29 with the first side 47, the first end 51' of the top 51, and the first end 53' of the bottom 53 being fixedly attached to the upper end 27' of the second end 27 of the first side truss 23. The second side 49, the second end 51" of the top 51, and the second end 53" of the bottom 53 is fixedly attached to the upper end 33' of the second end 33 of the second side truss 29, therefore, coupling the first side truss 23 and the second side truss 29 together. The uppermost part of the top 51 is aligned with the uppermost end of the upper end 27' of the first side truss 23, and upper end 33' of the second side truss 29 with the bottom 53, the first side 47, and the second side 49 extending downwardly therefrom, making a portion of the back of the basketball goal height reducing frame 11.

The linkage means 13 also includes a horizontal first cross truss member 57 comprising a first side 59, a second side 61, a first end 63, a second end 65, and a diagonal brace 67. The first side 59 and the second side 61 are in parallel spaced relationship and the first end 63 and second end 65 are likewise in parallel spaced relationship. The front end 59' of the first side 59 is rigidly attached to one side of the first end 63 with the back end 59" of the first side 59 being rigidly attached to one side of the second end 65. The front end 61' of the second side 61 is rigidly attached to the other side of the first end 63 and the back end 61" of the second side 61 is rigidly attached to the other side of the second end 65, therefore, forming the substantially rectangular first cross truss member 57. The brace 67 is rigidly attached at one end to the corner where the front end 59' of the first side 59 and one side of the first end 63 converge. The brace 67 adds strength and maintains the rectangular shape of the first cross truss member 57.

The front end 59' of the first side 59 of the first cross truss member 57 is aligned with and fixedly attached to the uppermost part of the upper end 25' of the first end 25 of the first side truss 23 with the first side 59 running the entire length parallel with the horizontal cross member 26 and with the back end 59" of the first side 59 being aligned with and fixedly attached to the second end 27 of the first side truss 23. The front end 61' of the second side 61 of the first cross truss member 57 is fixedly attached to and aligned with the opposite uppermost part of the upper end 31' of the first end 31 of the second side truss 29 with the second side 61 running the entire length parallel with the horizontal cross member 32 and with the back end 61" of the second side 61 aligned with and fixedly attached in a manner apparent to those skilled in the art to the second end 33 of the second side truss 29.

The first cross truss member 57 is the top horizontal cross truss member and positioned so that the first end 61 is perpendicular to the first end 25 of the vertical first side truss 23 and the first end 31 of the vertical second side truss 29.

The linkage means 13 inludes a second cross truss member 69 which lies substantially below and parallel with the first cross truss member 57 and is identical in shape and construction thereto. The second cross truss member 69 comprises a first side 71, a second side 73, a first end 75, a second end 77, and a diagonal brace 79. The first end 75 is rigidly attached at one end to the front end 71' of the first side 71 with the other end being rigidly attached to the front end 73' of the second side 73 to constitute the front thereof. The second end 77 is rigidly attached at one end to the back end 71" of the first side 71 and the other end is rigidly attached to the back end 73" of the second side 73 constituting the back portion of the second cross truss member 69. The brace 79 runs diagonally from the corner where the front end 71' of the first side 71 and the first end 75 converge to the opposite back corner where the back end 73" of the second side 73 and the second end 77 converge. The brace 79 strengthens the second cross truss member 69 and maintains the rectangular shape thereof. The second cross truss member 67 is fixedly attached at one side to the first side truss 23 and the other side is fixedly attached to the second side truss 29. More specifically, the front end 71' of the first side 71 is aligned with and fixedly attached substantially to the center of the first end 25 of the first side truss 23 with the first side 71 running the entire length of the cross member 28 and which the back end 71" aligned with the lower end 27" of the second end 27 of the first side truss member 23. The front end 73' of the second side 73 is aligned with and fixedly attached substantially to the center of the first end 31 of the second side truss 29 with the second side 73 running along the entire length of the cross member 34 and with the back end 73" aligned with and fixedly attached thereto the lower end 33" of the second end 33 of the second side truss 29.

The second cross truss member 69 is spaced at a substantial distance below the first cross truss member 57, therefore, creating a cavity of sufficient size as to allow the primary basketball goal 17' to fit therein between the upper first cross truss member 57 and the lower second cross truss member 69 as shown in phantom lines in FIG. 1.

Figure 4:
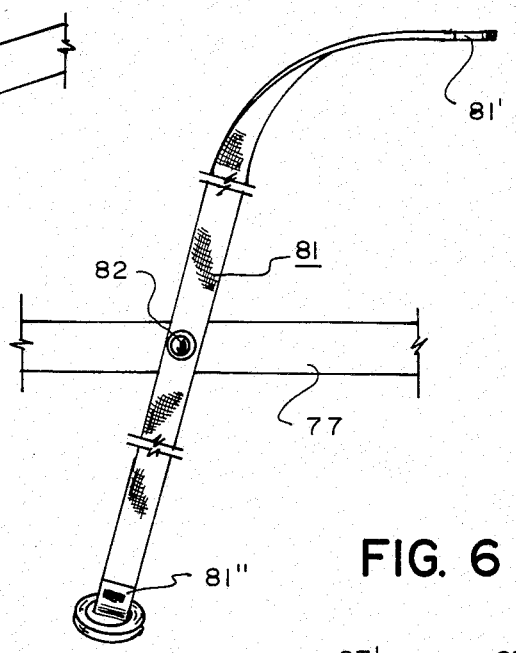
FIG. 4 is a view of a safety strap showing a portion of the frame thereof.
Figure 5:
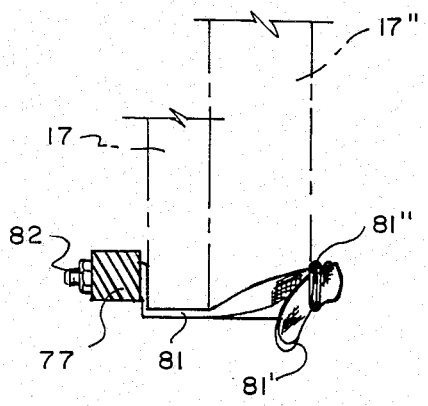
FIG. 5 is a view showing the safety strap attaching the basketball goal height reducing frame to the primary basketball goal and backboard assembly shown in phantom lines.

The second cross truss member 69 has a safety strap means 81 fixedly attached by any manner, such as a bolt and nut means 82 (as shown in FIGS. 4 and 5), to the center of the second end 77 for securely strapping the basketball goal height reducing frame 11 to the frame 17" of the primary basketball goal and backboard assembly 17. As shown in FIG. 5, the elongated safety strap means 81 may consist of an elongated length of a flat belting material having first and second ends 81', 81", respectively, with a pair of substantially circular locking rings fixedly attached to the second end 81" in a manner apparent to those skilled in the art. The safety strap means 81 may be of the type commonly used on most backpacks and sporting gear for allowing a fast hookup and easy release thereof in a manner well-known to those skilled in the art.

Figure 6:
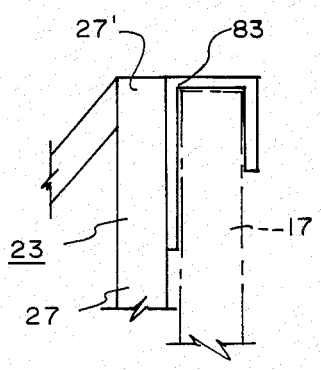
FIG. 6 is a view of a portion of the upper end of the truss member and hanger means that is hooked over the top of the primary basketball backboard assembly shown in phantom lines.

The hanger means 15 includes a first hook member 83 fixedly attached to the back upper end 27' of the second end 27' of the second end 27 of the first side truss 23 for being hooked over the top edge of the backboard assembly 17 of the primary basketball goal 17' and a second hook member 85 fixedly attached to the back upper end 33' of the second end 33 of the second side truss 29 for being hooked over the top edge of the backboard assembly 17 of the primary basketball goal 17'. The first and second hook members 83, 85 may be constructed out of a rigid metal stock and bent in a manner as to form upside down J-shaped brackets. Therefore, one side (preferably the longest side) of the brackets are respectively fixedly attached in a manner apparent to those skilled in the art to the back upper end 27' of the second end 27 of the first side truss 23 and to the back upper end 33' of the second end 33 of the second side truss 29 and with the intermediate portions of brackets 83, 85 resting on the top edge of the backboard assembly 17, therefore, supporting the weight of the basketball height reducing frame 11, and with the other ends of the brackets 83, 85 being engaged behind the top edge of the backboard assembly 17 hooking the frame 11 thereon. (See FIGS. 1, 2 and 6).

When the basketball goal height reducing frame 11 is hooked over the top edge of the backboard assembly 17, the primary basketball goal 17' fits into the cavity between the first cross truss member 57 and the second cross truss member 69, therefore placing the safety strap means 81 substantially close to the bottom of the backboard assembly 17 so that safety strap means 81 may be placed under the backboard assembly 17 and around the primary basketball goal frame 17" and attached thereto in a manner well-known to those skilled in the art. (See FIG. 5).

Support means 19 includes a pair of upwardly extending first and second support members 87, 89 fixedly attached to the front of the basketball goal height reducing frame 11. The first support member 87 is fixedly attached substantially to the left side of the first end 63 of the first cross truss member 57, the first end 75 of the second cross truss member 69, the top 41 of the first end truss member 35, and the bottom 43 of the first end truss member 35. The second support member 89 is fixedly attached substantially to the right side of the frame 11 to the first end 63 of the first cross truss member 57, the first end 75 of the second cross truss member 69, the top 41 of the first end truss member 35, and the bottom 43 of the first end truss member 35 in a manner apparent to those skilled in the art. (See FIG. 1). The support members 87, 89 are substantially the same height in respect to the first end 25 of the first side truss 23 and the first side 31 of the second side truss 29. The first and second support members 87, 89 have a plurality of apertures therethrough through which may be extended the bolt means 91 for securing an auxiliary basketball goal 21 and backboard 21' thereto at various heights. When desiring the 8.5 foot (2.55 m) height, the bolt means 91 are extended through aperture 93 and when desiring the 9 foot (2.7 m) height, the bolt means 91 are extended through apertures 95. The first and second support members 87, 89 are spaced apart at a distance parallel to one another in a manner apparent to those skilled in the art.

The rigid construction of the first side truss 23, the second side truss 29, the first end truss member 35, the second end truss member 45, the first cross truss member 57, the second cross truss member 69 along with the support members 87, 89 allows ease in the manufacturing and shipping of the basketball goal height reducing frame 11, and also allows the user or purchaser to quickly put the frame 11 together.

The basketball goal height reducing frame 11 may be easily installed on the primary basketball goal 17' and backboard assembly 17 by simply lifting the frame 11 up and resting horizontal bottom 53 of second end truss 45 on the primary basketball goal 17' and letting it hang there while a ladder, etc. is obtained to stand on so that the basketball goal height reducing frame 11 may be lifted higher to hook the hanger means 15 over the top of the primary backboard assembly 17. Then the safety strap means 81 thereof is fastened. To remove the basketball height reducing frame 11 from the primary basketball goal 17' and backboard assembly 17 you simply release the safety strap means 81 and lift the frame 11 up and out, therefore, unhooking the hanger means 15 from the top edge of the primary backboard 17. When the frame 11 is away from the backboard 17 just lower the frame 11 down and place horizontal bottom 53 of second end truss 45 on the primary basketball goal 17' letting it hang there until you get down off the ladder, etc. and on to the floor. Then the frame 11 is lifted up and out to remove horizontal bottom 53 of second end truss 45 from the primary goal 17'. The frame 11 is then placed on the floor.

The entire job of removing or replacing the frame 11 is easily done by two men. Also, note that no damage or alterations are done to the primary basketball goal 17' which is protected in the cavity of the frame 11.

The basketball height reducing frame 11 is not limited for use only on backboards or in gymnasiums but may also be installed on any framework that would allow the hanger means 15 to be placed over the top thereof.

As thus constructed, the basketball goal height reducing frame 11 provides a safe, sturdy, lightweight frame for the attachment of a regulation size auxiliary basketball goal 21 and backboard assembly 21', therefore, allowing smaller children to play the game of basketball at a reduced height thereby developing their playing skill that they can use later in life.

Although the invention has been described and illustrated with respect to a preferred embodiment thereof, it is not to be so limited since changes and modifications can be made which are within the full intended scope of the invention.

I claim:

1. A basketball goal height reducing frame for securing an auxiliary basketball goal/backboard assembly at a lower height with respect to a primary basketball goal/backboard assembly, said frame comprising:

(a) support means for being securely attached to the backside of the backboard of the auxiliary basketball goal/backboard assembly;

(b) hanger means for being securely attached to the backboard of the primary basketball goal/backboard assembly; and (c) linkage means for linking said support means and said hanger means with said support means located beneath said hanger means; said linkage means including a first side truss having first and second ends, a second side truss having first and second ends, a first end truss having first and second sides, and a second end truss having first and second sides; said first side of said first end truss being rigidly attached to said first end of said first side truss; said second side of said first end truss being rigidly attached to said first end of said second side truss; said first side of said second end truss being rigidly attached to said second end of said first side truss; said second side of said second end truss being rigidly attached to said second end of said second side truss; said first and second ends of said first and second side trusses having lower and upper ends; said upper ends of said first ends of said first and second side trusses being lower than said upper ends of said second ends of said first and second side trusses; said lower ends of said first ends of said first and second side trusses being lower than said lower ends of said second ends of said first and second side trusses.

2. The frame of claim 1 in which said hanger means includes first and second hook members for being hooked over the top edge of the backboard of the primary basketball goal/backboard assembly; said first hook member being securely attached to said upper end of said second end of said first side truss; said second hook member being securely attached to said upper end of said second end of said second side truss.

3. The frame of claim 2 in which support means includes first and second support members fixedly attached to said first end truss, each of said first and second support members having a plurality of apertures therethrough for allowing the backboard of said auxiliary basketball goal/backboard assembly to be mounted at various heights.

4. The frame of claim 3 in which is included safety strap means for strapping said linkage means to the primary basketball goal/backboard assembly.

* * * * *